US007673467B2

(12) United States Patent
LaRose, Jr.

(10) Patent No.: US 7,673,467 B2
(45) **Date of Patent: *Mar. 9, 2010**

(54) REFRIGERATED DISPLAY MERCHANDISER WITH LIGHT FILTER

(76) Inventor: Leo D. LaRose, Jr., 39916 Jason Ct., Novi, MI (US) 48375

( * ) Notice: Subject to any disclaimer, the term of this patent is extended or adjusted under 35 U.S.C. 154(b) by 497 days.

This patent is subject to a terminal disclaimer.

(21) Appl. No.: 11/644,418

(22) Filed: Dec. 22, 2006

(65) Prior Publication Data

US 2007/0180842 A1 Aug. 9, 2007

Related U.S. Application Data

(63) Continuation-in-part of application No. 11/197,788, filed on Aug. 4, 2005, now Pat. No. 7,360,374.

(60) Provisional application No. 60/600,623, filed on Aug. 11, 2004.

(51) Int. Cl.
*A47F 3/04* (2006.01)

(52) U.S. Cl. ..... 62/246; 62/264; 359/361

(58) Field of Classification Search ..... 62/246–256, 62/264; 359/361, 507, 513
See application file for complete search history.

(56) References Cited

U.S. PATENT DOCUMENTS 5,458,407 A * 10/1995 Bustos et al. ..... 312/116
6,773,104 B2 * 8/2004 Cornelius et al. ..... 347/106
7,360,374 B2 * 4/2008 LaRose, Jr. ..... 62/246

* cited by examiner

*Primary Examiner*—William E Tapolcai
(74) *Attorney, Agent, or Firm*—The Weintraub Group, PLC

(57) ABSTRACT

A refrigerated display merchandiser in which is stored food products and which is ordinarily exposed to prevailing ambient light is provided with transparent sheets which function as filter media to prevent harmful light from reaching the foods stuffs. The filtering media comprises a transparent sheet affixed to the display merchandiser as well as about any fluorescent lighting disposed within the merchandiser. The transparent sheet is either clear (untinted), or tinted, and passes either red or blue light or alternatively, absorbs ultraviolet light including both UV-A light and UV-B light.

17 Claims, 2 Drawing Sheets

REFRIGERATED DISPLAY MERCHANDISER WITH LIGHT FILTER

CROSS REFERENCE TO RELATED APPLICATIONS

This is a continuation-in-part application and claims priority benefit of U.S. patent application Ser. No. 11/197,788, filed Aug. 4, 2005 now U.S. Pat. No. 7,360,374, which claims priority benefit of U.S. Provisional Patent Application Ser. No. 60/600,623, filed Aug. 11, 2004, the entire contents of these applications hereby incorporated by reference.

BACKGROUND OF THE INVENTION

1. Field of the Invention

The present invention pertains to a refrigerated merchandise enclosure having a view panel for displaying perishable food articles, and more particularly, to such an enclosure having a color filter for protecting perishable food articles from deterioration arising from a prolonged exposure to harmful light, whether interior or exterior to the enclosure, while permitting the articles to be clearly seen and discerned by a purchaser when looking at the view panel.

2. Description of the Prior Art

Modern displays of fresh foods are brightly lit in keeping with the idea that shoppers are attracted to and prefer bright displays, which in turn leads to improved sales volumes for retailers. What is less understood is the impact of this retail lighting on food safety, shelf life and the negative impact of off colors created by the yellow and green spectra produced by general lighting products. Food does not last once it is exposed to light and radiation from heat in the store and artificial light sources. This is especially true for refrigerated products as they are the most sensitive to reduced shelf life from lighting and heat.

All food display lighting causes surface heating and promotes the photochemical process that contribute discoloration, oxidation (i.e., drying), and food borne pathogen growth. The brighter the light the greater the damage. As such, display lighting and ambient light around the display cabinet may be a source of damage to the safety and appearance of the products the seller is trying to merchandise. Desirably, a refrigerated merchandise display case would minimize harmful glaring light reaching the food product without detracting from the visibility of the product promoted in the display case.

Typically, food products in the refrigerated display case are illuminated by ambient daylight and by artificial lighting (e.g., fluorescent and incandescent lights) that is in the store (and exterior to the display case) and inside the display case. In some applications, the artificial lighting hurts a fresh merchandise presentation by overpowering a display case with glaring light, causing products to appear washed out and unattractive. Energy in the form of sunlight has several components: infrared, visible, and ultraviolet. The ultraviolet has the highest energy and the greatest potential for damaging sensitive products.

Radiation from lighting works directly against the moisture and temperature controls in refrigerated display cases, dehydrating, oxidating, and heating merchandise through invisible wavelengths. Studies show that lighting produces several types of radiation that can be damaging to specific products. Ultraviolet and infrared radiation, for example, is associated with surface drying and internal heating of merchandise. Further, certain parts of the visible spectrum, in particular those emphasized by regular fluorescents, can have damaging effects on fresh products, such as meat, where bacterial growth is a major concern.

An object of this invention is the provision of a refrigerated merchandising display case for increasing the shelf life of perishable foods in the display case and exposed to glaring ambient and ultraviolet light sources by inhibiting the light from entering the viewing panel of the display case and reaching the food, causing the foods to appear washed out and unattractive.

An object of this invention is a refrigerated merchandising display case and a transparent filter arrangement therefor that enables the merchandiser to block, or at least substantially reduce, most of the ultraviolet and infrared radiation that might otherwise reach sensitive food products. The filter may comprise a thin sheet of polymeric material that is clear or tinted but enables a purchaser to clearly discern articles in the display case.

Advantageously, reduction of harmful UV rays translates into longer shelf life and pleasing appearance for the items displayed.

Another object of this invention is the provision of a refrigerated display case having an arrangement for conditioning light which reaches prepared food products in the display case, which promotes superior presentation with extended freshness, whereby to help the merchandiser to increase purchases based on eye appeal.

Although intended to promote sales of prepared food, an object of this invention is the provision light filtering in a refrigerated merchandise display case to promote the sales of fresh deli meat, such as beef, seafood, and poultry, salads, bakery goods, and floral items, to name a few.

An advantage of filtering harmful and damaging light from refrigerated food products is reduced shrinkage and extended shelf life without having to replace light sources. Reduced shrinkage, discoloration, and drying out of packaged food products correlates into fewer items that are thrown out due to drying or other damage.

Another object of this invention is a display case, which includes a fluorescent light source for illuminating perishable and non-perishable foods and an arrangement for filtering UV energy from the light source from reaching the perishable foods. The UV filter is preferably a thin polymeric sheet of transparent film, whether tinted or clear.

A related object is the provision of a display case exposed to ambient lighting and having a viewing panel for viewing perishable and non-perishable foods within the case, and a color filter selectively attached to the viewing panel for inhibiting the ambient light from reaching the perishable foods.

SUMMARY OF THE INVENTION

The present invention is a refrigerated display merchandiser exposed to prevailing exterior ambient light and used for storing and displaying perishable articles of food. According to one embodiment of the invention, the display merchandiser comprises:

a display case having an exterior and an interior, said interior defining a refrigerated product display region and said display case having an transparent front viewing area for viewing perishable articles displayed in the display region, and means for protecting the perishable foods in said product display region from exposure to harmful effects of light of a predetermined frequency.

The means for protecting is adapted to protect a predetermined food product, such as a prepackaged sandwich, delimeat, salad, and bread and comprises a transparent sheet capable of passing light in a predetermined range and absorbing light in all other ranges. The transparent sheet may be tinted or clear (i.e., not tinted) and in either case enables a purchaser to clearly see (without distortion or blur) the items to be purchased.

Depending on the perishable food product, a transparent sheet according to this invention passes light in the red range (about 620-780 nm) or the blue range (about 440-490 nm) and absorbs substantially all other light.

Further, the transparent sheet according to this invention absorbs light in the ultraviolet range (about 320-400 nm), such as UV-A light and UV-B light, which light has been a factor, which deteriorates the value of various commercial products.

Preferably, the front viewing area comprises a pane of glass, and when juxtaposed atop a surface of the pane of glass, the transparent sheet blocks about 98-99% of the UV-A and UV-B light while maintaining excellent clarity. The attachment may be temporary, such as hung, or in encircling relation, such as around the fluorescent light tube, or by lamination thereatop.

Preferably, the pane of glass is about ⅛ inch thick.

In a preferred aspect, the transparent sheet has a minimum thickness of about 15-20 mils, and more preferably, about 16 mils, enabling the sheet to be rolled, unrolled, and otherwise applied to both planar viewing windows as well as irregular surfaces.

In another embodiment, a display merchandiser for perishable articles of food comprises:

means for defining an enclosed refrigerated space for the articles of food, said means for defining including an array of enclosure walls, at least one display shelf, said shelf being associated with the enclosure walls and cooperating to divide the refrigerated space into a first and a second zone, said first zone for storing and displaying the perishable food, at least one view panel, said view panel providing visual access to the refrigerated space and the zones therein whereby to enable the user to identify at item of interest and ambient light to pass freely into the refrigerated space, means for permitting user access into the refrigerated space and the zones therein whereby to enable the user to select and remove a perishable article from the first zone or an item from the second zone, means for lighting the refrigerated space, said means for lighting being disposed within the refrigerated space, means for protecting the perishable foods in said first zone from exposure to harmful effects of light of a predetermined frequency from reaching the perishable food articles in the refrigerated space.

The display case includes a door that permits user access to the food articles in the refrigerated zone, and the means for protecting is as described herein above, and comprises a sheet or film of transparent material that both permits the user to clearly see the food articles and filter out light of a certain range from reaching the food articles. The transparent sheet or film blocks out harmful UV rays and is either clear (i.e., not tinted) or tinted (e.g., red). Importantly, the sheet does not effect the ability of the purchaser to clearly see the items in the display case.

BRIEF DESCRIPTION OF THE DRAWINGS

The various features and advantages of this invention will become apparent to those skilled in the art from the following detailed description of a preferred embodiment with reference to the accompanying drawings, in which like reference numbers refer to like parts, and wherein.

DETAILED DESCRIPTION OF THE PREFERRED EMBODIMENT

Figure 1:
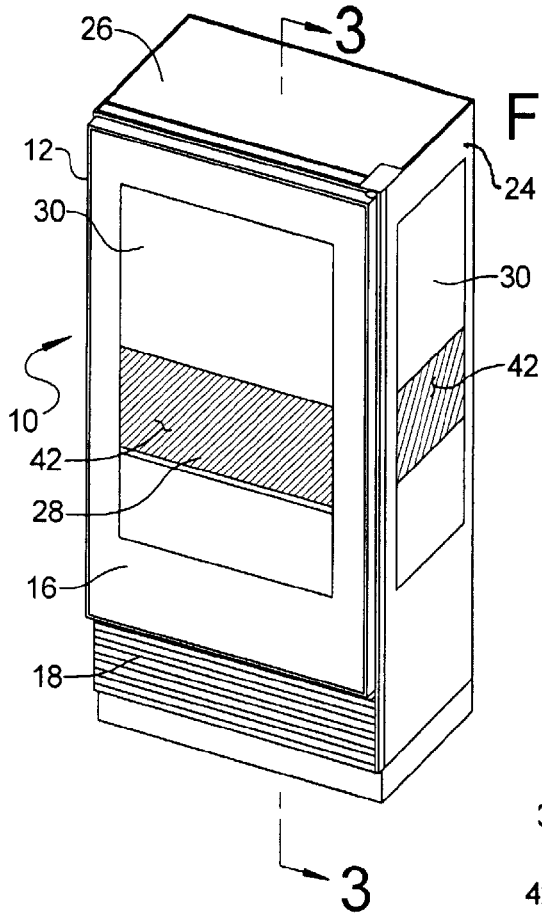
FIG. 1 is a front perspective view of a preferred embodiment of a refrigerated display merchandiser with light filter for protecting perishable foods in the display from harmful exterior light, according to the present invention.
Figure 2:
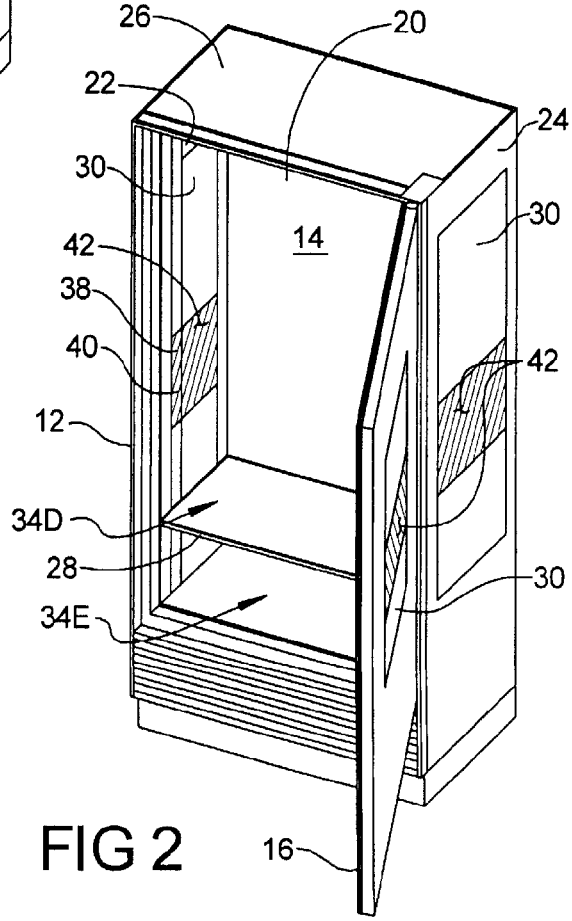
FIG. 2 is a front perspective view of the refrigerated enclosure of FIG. 1 showing a door thereof open for removing articles from the display merchandiser.
Figure 3:
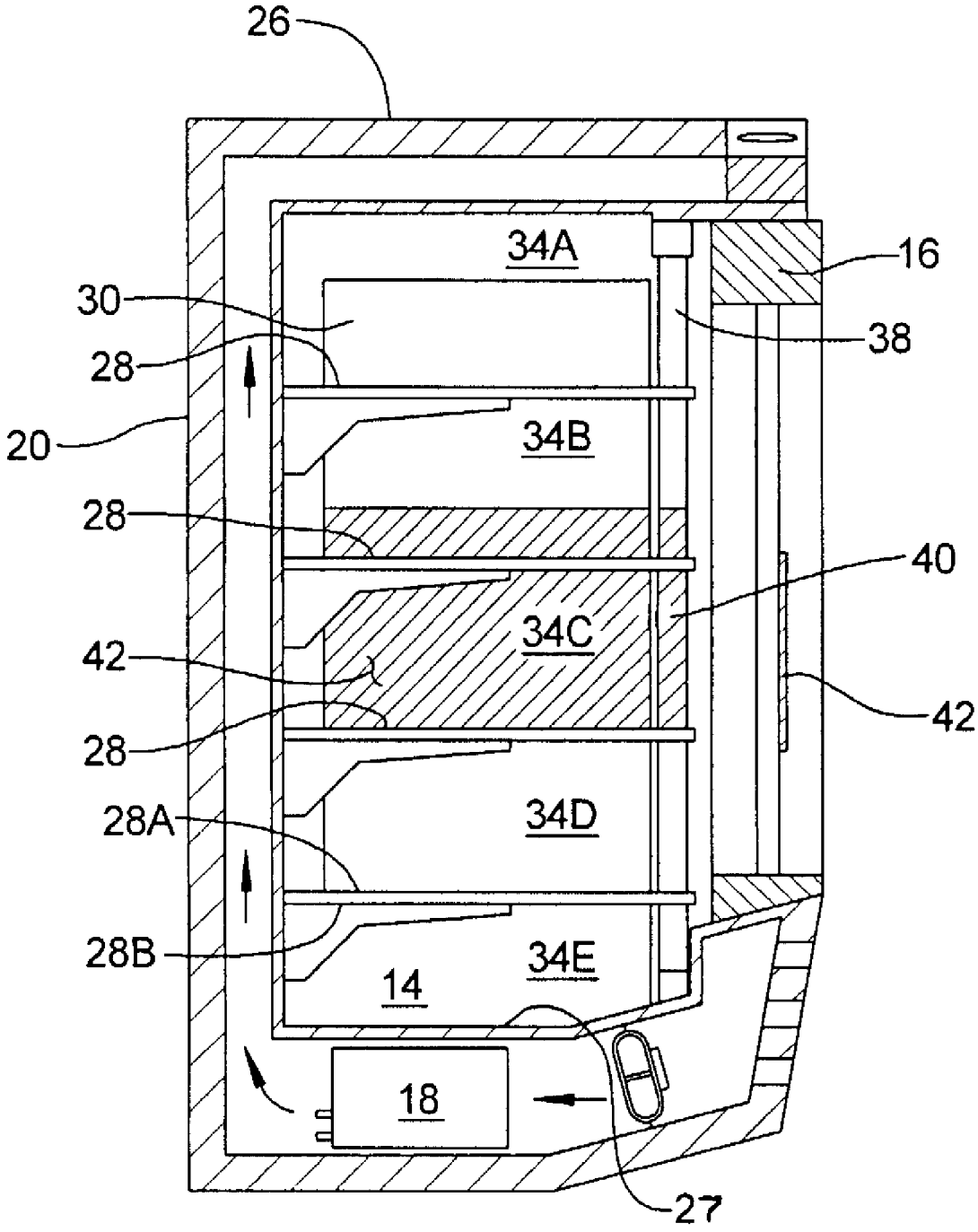
FIG. 3 is a view taken along line 3-3 of FIG. 1 illustrating several product display zones in the interior of the display merchandiser, a fluorescent light for lighting the interior, and a light filter for protecting perishable foods in one of the display zones from harmful effects of the fluorescent light.

Turning to FIG. 1, a refrigerated display merchandiser 10 includes a generally rectangular display cabinet 12 that defines an interior space 14 for storing and viewing perishable food, comestibles, beverages and drinks, salads, and the like for sale, a door 16 for gaining access to the interior space, and a cooling module 18 for cooling the interior space. The display case 12 includes a plurality of walls, including a back wall 20, a pair of opposed sidewalls 22 and 24, a top wall 26, and a bottom wall 27.

The door 16 forms, at least in part, the front wall of the cabinet 12. The walls 20, 22, 24, 26, and 27 and the door 16 form the interior space 14.

Preferably, the door 16 includes at least one view panel 30 providing visual access to at least a portion of the refrigerated space 14 and the articles therein. Further, depending on the application, one or more of the sidewalls 22 and 24 and the back wall 20 may include a view panel, such as the view panel 30, wherein to increase the ability of passers-by to view the interior refrigerated space 14 and the merchandise therein.

The view panel 30 is transparent, and comprises a pane of glass which permits the shopper to clearly see and distinguish the color and the objects placed in the space 14. The glass 30 is sufficient in thickness to retain cooling in the interior 14, and is about ⅛ inch thick.

The display merchandiser 10 is adapted to be emplaced in a store, and the exterior walls of the merchandiser 10 are exposed to fluorescent lighting used in the store to illuminate the display merchandiser, as well as other items in the store. Additionally, the display merchandiser 10 may be exposed to ambient daylight or sunlight. In both cases, the view panels 30 are exposed to store light and the ambient daylight/sunlight, which light will enter into the interior space 14 and illuminate the articles in the display case 10.

A plurality of generally flat, planar display shelves 28 are horizontally disposed in the refrigerated space 14 and define a plurality of vertically separated display zones 34A, 34B, 34C, 34D, and 34E. Each shelf 28 extends laterally between the sidewalls 22 and 24 and between the back wall 20 and door 16, and includes, respectively, top and bottom surfaces 28A and 28B. A display zone 34 is defined by the volume of air disposed between the end walls 22 and 24, the back wall 20 and door 16, and above and below the top and bottom surfaces 28A and 28B of each respective pair of successive shelves 28 for the display of merchandise.

According to this invention, at least one of the zones 34 is used to display a predetermined perishable food product, such as a prepackaged sandwich, deli-meat, salad, and bread. Another zone may be used to display non-perishable articles of food, such as beverages, puddings, and the like. In the embodiment shown, the zone 34C is used for storing perishable food articles, and the zones 34A, 34B, 34D, and 34E are used to display non-perishable articles of food, such as beverages.

A source of lighting is provided to illuminate the refrigerated interior space 14 of the display merchandiser. As shown, an elongated fluorescent light tube 38 is disposed against each sidewall 22 and 24, and each extends vertically between the top and bottom walls 26 and 27.

While shown extending horizontally, the fluorescent light tubes 38 may be disposed horizontally and extend between the side walls 22 and 24.

Preferably and according to this invention, a color filter is provided for protecting the perishable foods in the zone 34C of the refrigerated space 14 from exposure to harmful effects of light of a predetermined frequency from reaching the perishable food articles. According to this invention, a colored sheet or film 40 of transparent material is selectively positioned about and along a predetermined section of the fluorescent light(s) 38, and a sheet 42 is selectively positioned on the view panel 30, each colored sheet or film 40 and 42 being in juxtaposed relation with the zone 34C. The colored sheets 42 permit the user to view and clearly discern the food articles placed on the other side of it but filter out light of a certain range. Further, the products displayed in the zones 34A, 34B, 34D and 34E are seen directly through the panel 30 and are not protected from harmful light.

Depending on the perishable food product, a transparent colored film or sheet 40 and 42 according to this invention passes light in the red range (about 620-780 nm) or the blue range (about 440-490 nm) and absorbs substantially all other light. The transparency varies according to the wavelength of light.

Further, and depending on the perishable food product, a transparent colored film or sheet 40 and 42 according to this invention absorbs light in the ultraviolet range (about 320-400 nm), such as UV-A light and UV-B light, which light has been a factor which deteriorates the value of various commercial products.

Preferably, when applied to a surface of the pane of glass 30 or fluorescent light 38, the transparent colored sheet 40 and 42 blocks about 98-99% of the UV-A and UV-B light while maintaining excellent clarity.

In a preferred aspect, the transparent colored sheet 40 and 42 has a minimum thickness of about 15-20 mils, and more preferably, about 16 mils, enabling the sheet to be rolled, unrolled, and otherwise applied to both planar viewing windows as well as irregular surfaces (e.g., a fluorescent light).

Materials having the property of being colored and absorbing and passing light of a predetermined wavelength, transparent, and permitting objects to be clearly discerned comprise a thin strong polymeric film, such as a polyester film (e.g., Mylar®), and a thin, transparent sheet or tube of regenerated cellulose (e.g., cellophane).

The colored film or sheet 40 and 42 is referred to as being transparent, and comprises a material that (1) can be seen through in a manner that the refrigerated food objects placed on the other side may be clearly discerned, with little or no distortion, although the image seen may appear "tinted" because of the color of the film, and (2) permits and excludes electromagnetic radiation of specified radiation. That is, the colored film or sheet 40 and 42 selectively passes light in a certain part of the electromagnetic spectrum and absorbs (i.e., is opaque to) light in the ultraviolet and infrared regions of the light spectrum, such as that from unfiltered sunlight or fluorescent lamps. A filter that passes light partially or diffusely, without revealing the image on the other side of the screen (i.e., translucent) would not be used.

Additionally, the sheets 40 and 42 are shown herein as being fitted, where desired, about the view panels 30 and the fluorescent lights 38 of the display cabinet 12. This provides flexibility and permits the user to change the location of the sheets and the display zones that are to be protected from harmful light. In some applications, the filter sheet may be removed and none of the zones 34 are protected. In other applications, the entire view panel may be colored, such as with a tinted glass, and always form a filter against UV and light of a certain frequency.

In other applications it is possible, if the glass, per se, for the display case is tinted, then just the fluorescent lamps or lighting may be covered with the transparent sheet.

In covering the fluorescent lamp or lighting any suitable mode may be used such as wrapping the transparent sheet therearound or forming a tube of the transparent material and selectively sliding the tube and affixing it to the lamp or light, or combinations thereof.

Furthermore, it should be noted that depending on the intensity of the fluorescent light, more than one sheet or tube may be used to cover the light.

Transparent materials can be seen through; that is, they allow clear images to pass. Most glasses are transparent and of a material that has the property of allowing light to pass. Translucent materials allow light to pass through them only diffusely, that is, the material distorts the image. Where the degree of transparency varies according to the wavelength of the light, the image seen through the material is tinted. This may be due to certain metallic oxide molecules in glass. If many such particles are present the material may become opaque, tye opposite of transparency.

In the merchandiser 10 herein, the ability to the purchaser to clearly see the items being sold is important. The viewing panels 30 of the merchandiser are typically of ordinary glass and glass is essentially transparent to UV rays (i.e., UV radiation passes right through), it is important herein that the film 40 or 42 provide UV protection. Most of the readily available window films are made of Mylar®, which is a DuPont trade name for a polycarbonate film. Polycarbonates (like most plastics) are inherently unstable when exposed to UV light, According to this invention, the film 40 and 42 is clear (i.e., untinted) and provided with a UV retardent to block UV radiation and make the film resistant to damage by UV radiation In this regard, predetermined glass viewing panels 30 of the merchandiser 10 as well as the fluorescent lighting tubes 38 are covered with a clear UV retardent film. The UV retardent film may be "hung", temporarily secured to a predetermined area(s) of the viewing panels, formed as a barrier or enclosure between the source of rays, such as encircling the light tubes, or substantially permanently laminated to some or all of a surface of interest, such as the entire viewing panel 30.

In this regard, a UV blocking film, marketed under the name Fade Control Window Film ("Fade Film") by CPFilms of Martinsville, Va., is available and will block up to 99.5 percent of UV-A and UV-B rays and improve the protection not provided by untreated windows. The Fade Film is provided in sheets that are about 3 feet by 15 feet and laminated atop the surface of a glass viewing panel.

In the refrigerated display merchandiser 10, the clear untinted transparent sheet of Fade Film is cut into desired size, wetted, and applied with a squeegee tool to the panel 30 and/or light 38, as needed.

It should be noted that the range of radiation protection or UV blocking provided by the tinted and the clear transparent sheets are substantially the same and block in 99.5% or more of the harmful UV rays. Depending on the application, both tinted and untinted transparent sheets may be used to protect the refrigerated food articles in the display space of the merchandiser.

Having, thus described the invention what is claimed is:

1. A display merchandiser comprising:

a display case having an exterior and an interior, said interior defining a refrigerated product display region and said display case having a transparent front viewing area for viewing perishable foods displayed in the display region, and first means for protecting the perishable foods in said product display region from exposure to harmful effects of light of a predetermined frequency, said first means for protecting comprising a clear and untinted transparent sheet of polymeric material juxtaposed against the transparent viewing area, wherein the transparent sheet has a minimum thickness of about 15 mils.

2. The display merchandiser of claim 1 wherein the transparent sheet passes light in ranges selected from the group consisting of 620 to about 780 nm or from about 440 to about 490 nm or which absorbs light in the range from about 320 to about 400 nm.

3. The display merchandiser of claim 2 wherein the transparent sheet passes light in a range from about 620 to about 780 nm.

4. The display merchandiser of claim 2 wherein the transparent sheet passes light in a range from about 440 to about 490 nm.

5. The display merchandiser of claim 2 wherein the transparent sheet absorbs light in the ultraviolet range from about 320 to about 400 nm.

6. The display merchandiser of claim 2 which further comprises:

at least one fluorescent light disposed within the interior product display region, and further comprising second means for protecting the perishable foods disposed in the display region and disposed about the fluorescent light from exposure to harmful effects of light of a predetermined frequency emitted by said fluorescent light.

7. The display merchandiser of claim 6 wherein:

said second means for protecting the perishable foods comprises a transparent sheet of clear untinted film disposed about the light, said transparent sheet passing light in the range of about 620 to about 780 nm.

8. A display merchandiser for perishable articles of food comprises:

means for defining an enclosed refrigerated space for the articles of food, said means for defining including an array of enclosure walls, at least one display shelf in said refrigerated space, said shelf being associated with the enclosure walls and cooperating to divide the refrigerated space into a first and a second zone, said first zone for storing and displaying the perishable food, at least one view panel, said view panel providing visual access to the refrigerated space and the zones therein whereby to enable the user to identify an item of interest and ambient light to pass freely into the refrigerated space, means for permitting user access into the refrigerated space and the zones therein whereby to enable the user to select and remove a perishable article from the first zone or an item from the second zone, means for lighting the refrigerated space, said means for lighting being disposed within the refrigerated space, and means for protecting the perishable foods in said first zone from exposure to harmful effects of light of a predetermined frequency from reaching the perishable food articles in the refrigerated space, wherein the means for protecting the perishable foods has a minimum thickness of about 15 mils.

9. The display merchandiser of claim 8 wherein said means for protecting the perishable foods in said first zone from exposure to harmful effects of light of a predetermined frequency from reaching the perishable food articles comprises a clear and untinted transparent sheet affixed to the view panel, said transparent sheet passes light in ranges selected from the group consisting of 620 to about 780 nm or from about 440 to about 490 nm or which absorbs light in the range from about 320 to about 400 nm.

10. The display merchandiser of claim 8 wherein:

said means for protecting is disposed exteriorly of the merchandiser.

11. The display merchandiser of claim 9 wherein the transparent sheet passes light in a range from about 620 to about 780 nm.

12. The display merchandiser of claim 9 wherein the transparent sheet passes light in a range from about 440 to about 490 nm.

13. The display merchandiser of claim 9 wherein the transparent sheet passes light in the ultraviolet range from about 320 to about 400 nm.

14. The display merchandiser of claim 9 which further comprises:

at least one fluorescent light disposed within the display space for illuminating the food articles displayed therein, the display merchandiser further comprising means for protecting the perishable foods disposed about the fluorescent light from exposure to harmful effects of light of a predetermined frequency emitted from the fluorescent light from reaching the perishable food articles, said means for protecting comprising a clear and untinted transparent sheet which passes light in ranges selected from the group consisting of 620 to about 780 nm or from about 440 to about 490 nm or which absorbs light in the range from about 320 to about 400 nm.

15. The display merchandiser of claim 14 wherein the transparent sheet is a tube that envelopes the fluorescent light.

16. The display merchandiser of claim 8 wherein:

said means for protecting is a thin sheet of polymeric material, the sheet being transparent, clear, untinted, and laminated to the view panel.

17. The display merchandiser of claim 16 wherein said transparent sheet is disposed interiorly of the refrigerated space.

* * * * *